United States Patent [19]

Back et al.

[11] 4,174,103

[45] Nov. 13, 1979

[54] MAGAZINE FOR HOLDING A STACK OF SHEET MATERIAL

[75] Inventors: Günter Back, Hofheim-Diedenbergen; Reinhold Euler, Kelkheim, both of Fed. Rep. of Germany

[73] Assignee: Hoechst Aktiengesellschaft, Frankfurt am Main, Fed. Rep. of Germany

[21] Appl. No.: 894,326

[22] Filed: Apr. 7, 1978

[30] Foreign Application Priority Data

Apr. 9, 1977 [DE] Fed. Rep. of Germany ..... 2715948

[51] Int. Cl.[2] ..... B65H 1/04; B65H 3/56

[52] U.S. Cl. ..... 271/171; 271/164; 271/170

[58] Field of Search ..... 271/171, 170, 164, 162, 271/145, 223, 224, 144

[56] References Cited

U.S. PATENT DOCUMENTS

| | | | |
|---|---|---|---|
| 3,738,646 | 6/1973 | Samczyk | 271/170 |
| 3,934,870 | 1/1976 | Miller et al. | 271/171 X |
| 4,007,925 | 2/1977 | De Ryke et al. | 271/171 X |

*Primary Examiner*—Bruce H. Stoner, Jr.

*Attorney, Agent, or Firm*—Schwartz, Jeffery, Schwaab, Mack, Blumenthal & Koch

[57] ABSTRACT

Disclosed is a magazine for holding a stack of sheet materials and being adjustable to accommodate stacks of different size sheet materials, comprising: a base plate; two sliding plates mounted longitudinally displaceably on the base plate; a bottom plate positioned laterally displaceably in spaced relationship above the sliding plates; a cam follower mounted on the side of the bottom plate facing the sliding plates; longitudinal confining means for the stack of sheet materials mounted on one opposing axial end of each of the siding plates; lateral confining means for the stack of sheet materials mounted on at least one lateral side of the bottom plate; and means, including a lever pivoted on the base plate and positioned in the space between the sliding plates and the bottom plate and a cam disk pivoted on the base for rotation with movement of the lever and positioned above the lever in said space so as to engage the camming surface of the cam disk with the cam follower for longitudinally displacing the sliding plates and laterally displacing the bottom plate in response to movement of the lever.

25 Claims, 8 Drawing Figures

MAGAZINE FOR HOLDING A STACK OF SHEET MATERIAL

BACKGROUND OF THE INVENTION

This invention relates to a magazine adapted for holding stacks of sheets, film sheets or similar materials in different formats and which comprises adjustable limiting sides for the material stacked.

Such magazines are, e.g., used in electrophotographic copying machines, duplicating machines or other reproduction equipment, for holding stacks of sheets which are lifted off one at a time. Generally, the sheets are fed in via feed rollers which are mounted on a rotating shaft and are in contact with the uppermost sheet in the stack, engaging it by adhesion due to the friction of the rollers. The leading edge of the uppermost sheet is led over a sheet separating device and is thus lifted off from the remainder of the stack.

German Offenlegungsschrift No. 2,265,108 discloses a sheet feeder mechanism which comprises two plate members arranged in spaced relationship with respect to one another and serving to support the stack. The two plate members may be moved toward or away from one another by means of a manually operated adjusting mechanism, so that it is possible to adapt them to sheets of different widths. For this purpose, each plate member is equipped with an elongated portion provided with toothing which engages with a gear wheel located in a fixed position.

In this sheet feeder mechanism, the contact sides are adjusted in widthwise direction of the stack only, regardless of the length of the stack, and thus only two sides of the stack of sheets are guided by the contact sides. The plate members are moved toward one another or away from one another to adopt particular positions which, although shown by an indicator, are only exactly obtained manually if the operator is sufficiently skilled, since it may easily happen that by moving one of the plate members the gear wheel engaging with the toothing of the other plate member is caused to take one turn too many or too few so that the other plate member is displaced.

In German Offenlegungsschrift No. 2,359,081 a sheet conveyor mechanism is described comprising a support surface which is movably mounted in a frame and has a first edge guiding means rigidly attached to it and second edge guiding means moving relative to the first. The movable edge guiding means travels on a straight line and is either connected to a lever or joined to the support surface by means of a slot and pin assembly. This German Offenlegungsschrift also discloses a container having a support surface and two parallel edge guiding means which may be moved asymmetrically relative to the support surface and having an arrangement compensating for the displacement of the center line between the guiding means relative to the support surface.

The movable edge guiding means is connected to a plate provided with a mark which moves over a scale in the support surface to indicate the distance of the movable edge guiding means from the stationary edge guiding means. The compensating arrangement is necessary, in order to adjust the center line of the sheets in the stack to a fixed reference line in the machine, independently of the particular position of the movable edge guiding means. By means of this compensating arrangement, the center line of the support surface between the two guiding means is kept at a fixed distance from a sheet adjusting arrangement, so that the sheets are invariably pushed forward without adopting an oblique position relative to the center line of the machine.

German Offenlegungsschrift No. 2,358,769 relates to a sheet feeder mechanism comprising a base plate having edge guiding means which are displaceable relative to the base plate in order to contact the lateral edges of a stack. The two edge guiding means are arranged at right angles with respect to one another. Underneath the base plate, adjusting bars for the edge guiding means extend longitudinally and laterally with respect to the stack. There is further a locking member which is mounted so as to be displaceable together with the edge guiding means and is designed to engage in the surface of the bar along the path of the edge guiding means relative to the base plate. Also in this sheet feeder mechanism, the edge guiding means must be individually adjusted, and it depends, in the first place, on the skill of the operator, if the desired position of the adjustable guiding means is to be readily achieved.

SUMMARY OF THE INVENTION

It is therefore an object of the present invention to provide an improved device for holding a stack of sheet material, such as paper, films, etc.

A further object of the invention is to provide an improved magazine-type device for holding a stack of sheet material, particularly a magazine of adjustable size.

It is a particular object of the present invention to provide a simplified and improved magazine capable of adjustment to different lengths and widths of materials to be stacked, providing, at the same time, a continuous displacement of three contact sides of the magazine for the material to be stacked.

In accomplishing the foregoing objects of the invention, there has been provided a magazine for holding a stack of sheet materials and being adjustable to accommodate stacks of different size sheet materials, comprising: a base plate; two sliding plates mounted on the base plate so as to be longitudinally slideably displaceable with respect to each other; a bottom plate positioned in spaced relationship above the sliding plates and being mounted on the base plate so as to be laterally slideably displaceable; a cam follower mounted on the side of the bottom plate facing the sliding plates; means, mounted on one opposing axial end of each of said sliding plates, for longitudinally confining the stack of sheet materials; means, mounted on at least one lateral side of the bottom plate, for laterally confining the stack of sheet materials; and means, including a lever pivoted on the base plate and positioned in the space between the sliding plates and the bottom plate and a cam disk pivoted on the base for rotation with movement of the lever and positioned above the lever in said space so as to engage the camming surface of the cam disk with the cam follower, for longitudinally displacing the sliding plates and laterally displacing the bottom plate in response to movement of the lever.

In a preferred embodiment, the lever includes a longitudinal slot therein and the displacing means further includes a first pin attached to the base plate, about which the cam disk is rotatable, and a second pin attached to the cam disk, with both the first and second pins passing through the slot.

In accordance with another preferred embodiment, each of the sliding plates includes a slot extending transverse thereto, and the displacing means further includes third and fourth pins attached to the cam disk, one of these pins engaging with each of the transverse slots. Most preferably, the third and fourth pins also pass through the slot in the lever.

Most preferably, the magazine further includes two support plates, each of which is connected with one of the sliding plates and which are positioned in longitudinally spaced relationship on the bottom plate, and a cover plate which at least partly covers the two support plates.

Also, in a preferred embodiment, the base plate is generally rectangular and the two sliding plates are L-shaped, with the longer legs of the sliding plates extending in parallel with the long sides of the base plate and the shorter legs of the sliding plates extending in parallel with the narrow sides of the base plate, and wherein the sliding plates face one another in such a way that, when pushed together, they form a rectangle.

According to another preferred aspect, the lever is guided in two slot-shaped guideways extending in the base plate, the first extending in a straight line and the second extending from a common branching point intermediate the ends of the first, divergently away from the first, then parallel to the first and finally convergently to a point located on the imaginary extension of the first. A bar is secured to the underside of the base plate along the guideways and has three stop positions (A, B, C) below the first guideway and one stop position (D) below the second guideway, with the stop position (D) lying on the extension of the first guideway.

The camming surface of the cam disk comprises a guiding path including an inclined section (a), a circular section (b) with an indentation (c) and a bent section (d) having the shape of an elongate S, and the cam disk further includes an angular tongue pivotably mounted in section (a) of the guiding path and being spring biased against the wall of the guiding path opposite to the indentation (c).

The magazine according to the invention allows a rapid changeover from one format to another by adjusting a lever which locks in stop positions provided for each format to which the magazine may be set, at the same time displacing three contact or limiting sides for the stack in accordance with the format chosen. A manual displacement of the individual limiting sides and thus a stepwise approach to the desired positions of the limiting sides is, therefore, no longer necessary.

Further objects, features and advantages of the invention will become readily apparent from the following detailed description of preferred embodiments, when read together with the accompanying figures of drawing.

DETAILED DESCRIPTION OF PREFERRED EMBODIMENTS

Figure 1:
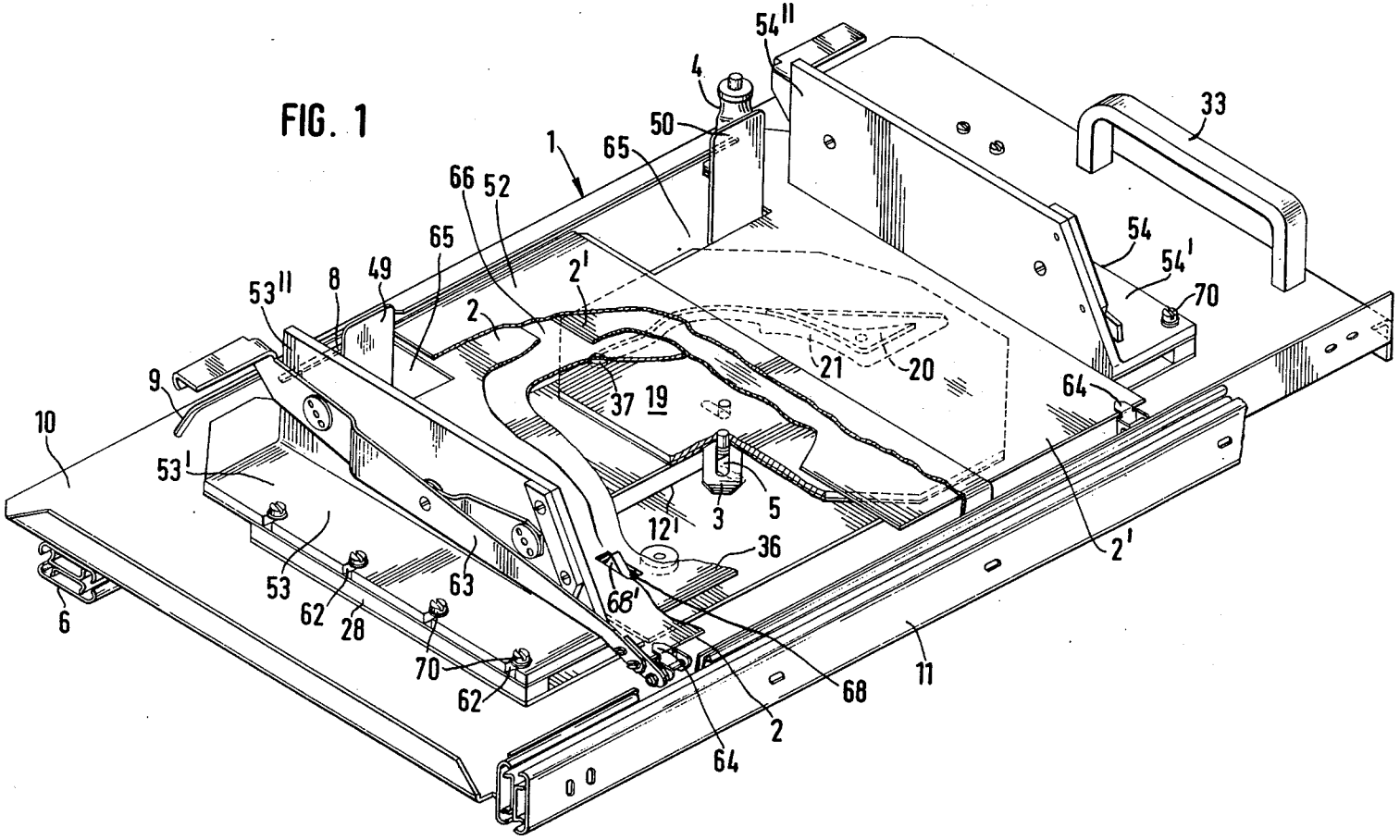
FIG. 1 is a perspective view of a magazine according to the invention, partly broken away.

The magazine 1 depicted in the figures of the drawing is designed to hold sheets, transparent sheets, film sheets or other materials in stacks of different formats. Such magazines are, e.g., used in electrophotographic copying machines for applying the developed and fixed image of an original onto the sheets taken from the stack.

Figure 2:
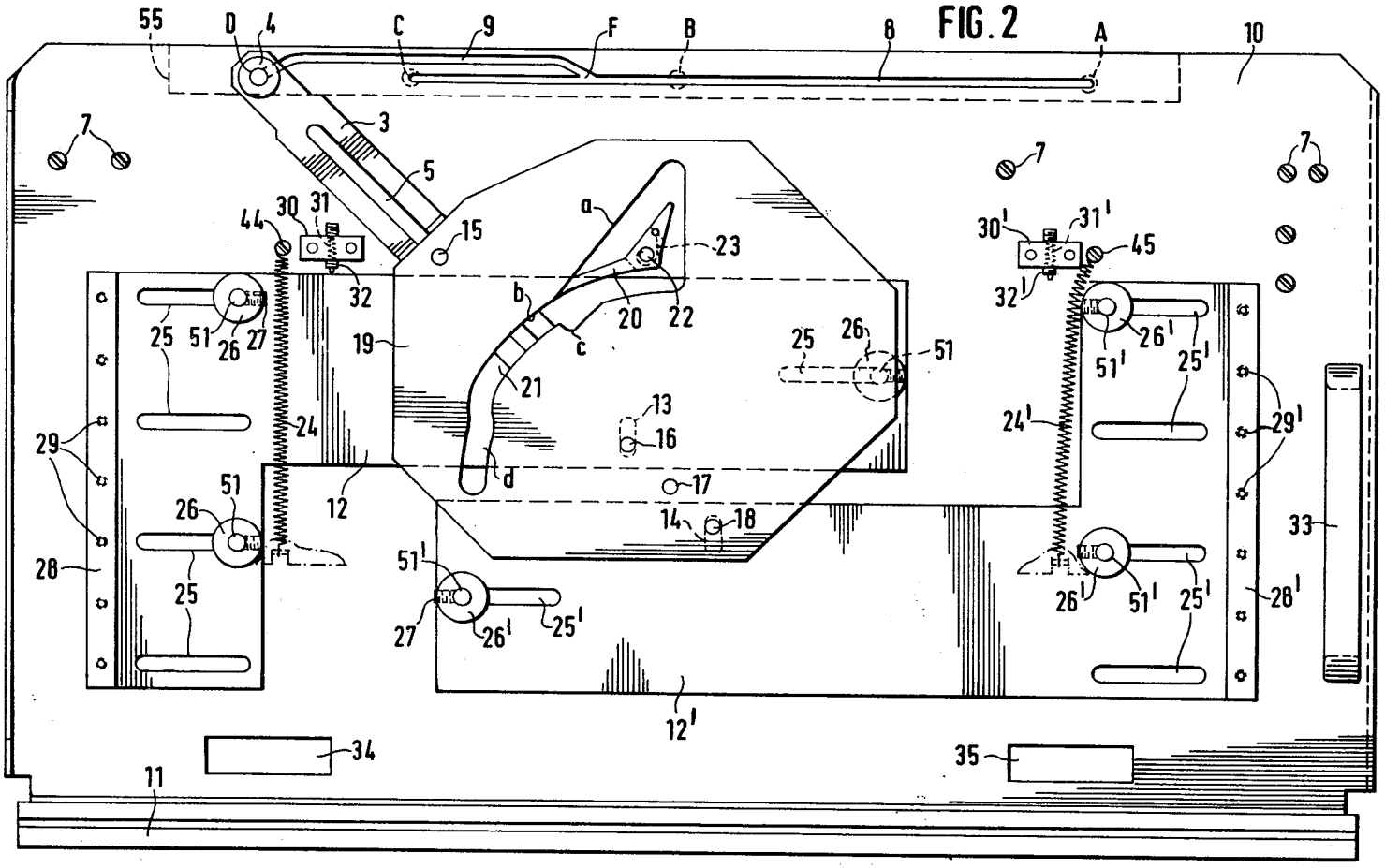
FIG. 2 is a plan (top) view of the magazine showing the base plate, the sliding plates, the lever and the cam disk.
Figure 3:
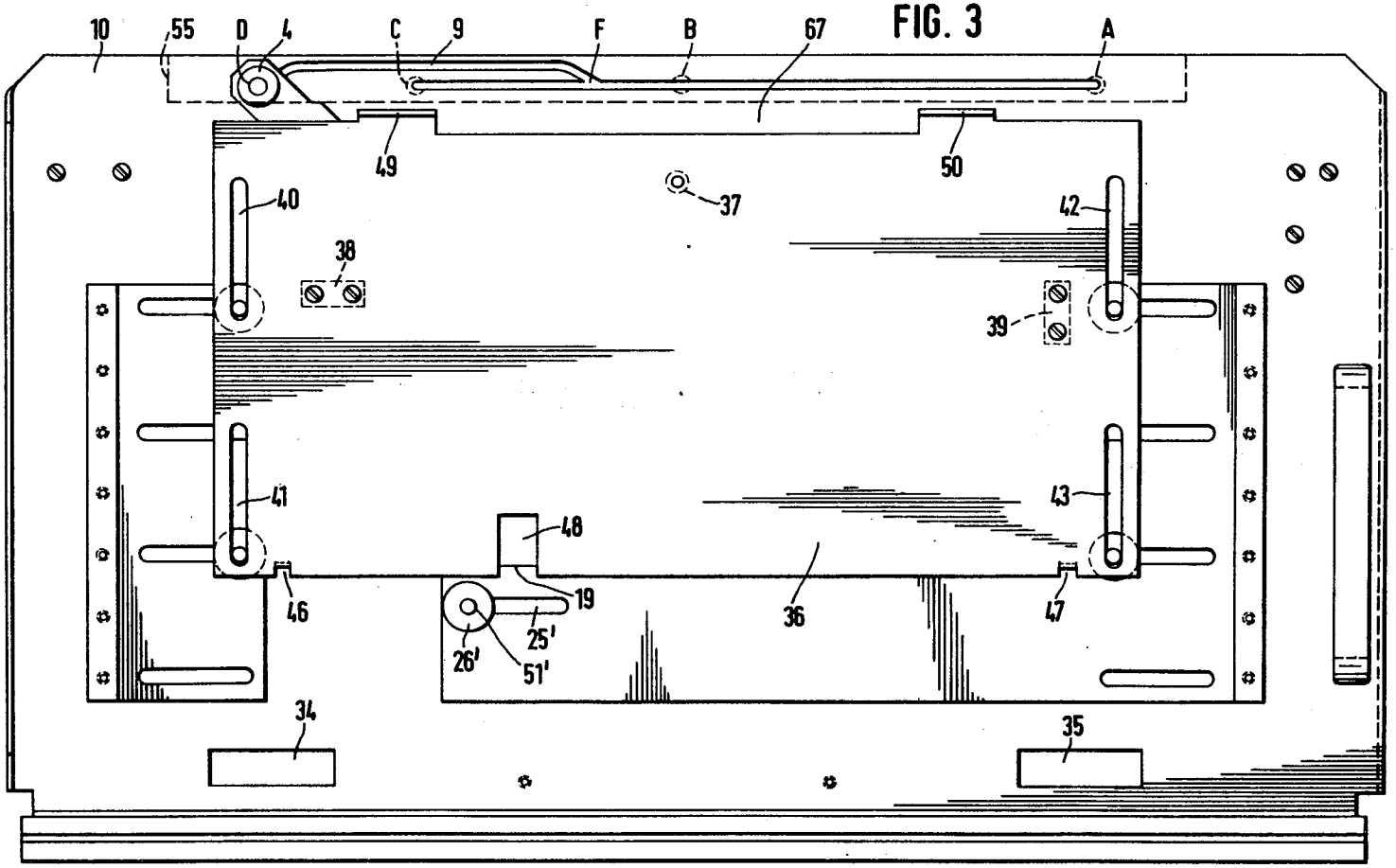
FIG. 3 is a plan view of the magazine according to FIG. 2, with the bottom plate in place.

The magazine 1 shown in FIGS. 1–3 comprises, from the bottom toward the top, a base plate 10, sliding plates 12, 12', a lever 3, a cam disk 19, a bottom plate 36, two support plates 2,2' and a cover plate 52. The L-shaped sliding plates 12,12' are displaceable relative to one another and are supported on the base plate 10. The lever 3 is provided with a longitudinal slot 5 engaged by pins 15 and 17, one of the pins being fastened to the base plate 10 and the other to the cam disk 19, the fastening being, e.g., by riveting. In FIG. 1, the lever 3 has adopted a stop position A in which the distance between the limiting sides of the magazine 1 corresponds to the DIN A 4 format of a stack to be placed into the magazine 1. The lever 3 can adopt four stop positions A, B, C and D spaced along guideways 8 and 9 in the base plate, as shown in FIG. 2. These four positions correspond, for example, in the order given below, to stacks having the formats DIN A 4 (210 mm×297 mm), 8½"×13" (216 mm×330 mm), 8½"×14" (216 mm×356 mm) and Japan B 4 (257 mm×364 mm). It is obvious that the magazine 1 may also be designed to accommodate any other format.

The bottom plate 36 is arranged above the cam disk 19 and has rear limiting lugs 49, 50 which, together with the limiting surfaces 53" and 54" of two angle brackets 53 and 54, form the limiting sides for the material stacked. These limiting sides constitute three contact sides for the material, and they are simultaneously displaced when the lever 3 is changed over from one stop position to another stop position, as will be explained below. Appropriately, the magazine 1 is adjusted to different formats while it is empty.

The magazine 1 is mounted in a frame of the copying machine, which is not shown, and the base plate 10 can be removed from this frame by means of a handle 33, e.g., when the magazine is to be filled with material. For this purpose, two pull-out slide bars 6 and 11 are attached to the base plate 10, the slide bar 6 being fastened by means of bolts 7 to the underside of the base plate at a short distance from and in parallel with one of its long sides, while the other slide bar 11 is laterally fastened to the other long side of the base plate 10. The base plate 10 is provided with several each of pins 51,51' for the sliding plates 12,12' and with a pin 17 for the cam disk 19.

As can best be seen from FIG. 2, the two sliding plates 12 and 12' are L-shaped and face one another in such a way that, when pushed together, they form a rectangle with a long side corresponding to the longer leg of the L and a narrow side corresponding to the shorter leg of the L. The longer legs of the sliding plates are parallel to the long sides, and their shorter legs are parallel to the narrow sides of the base plate 10. In the shorter leg of each sliding plate 12 and 12' four slots 25,25' are provided extending in parallel with the long side of the base plate 10, and there is another slot 25,25' spaced from these four slots, in the longer leg of each sliding plate. The last-mentioned slots 25,25' and at least two of the slots in each shorter leg of the sliding plates 12,12' are engaged by pins 51,51', each fitted with a spacer 26,26' determining the distance between the sliding plates 12,12' and the bottom plate 36. The pins 51,51' which are attached to the base plate 10 and engage the slots 25,25' in the sliding plates 12,12' produce the effect that the sliding plates can only move toward one another or away from one another in parallel with the longer sides of the base plate 10. Each spacer 26,26' is provided with a locking pin 27 adapted for holding the spacers on the pins 51,51' in different positions above the sliding plates 12,12', and thus to change the distance between the sliding plates 12,12' and the bottom plate 36 within given limits.

The outside edges of the shorter legs of the sliding plates 12,12' which are parallel to the narrow sides of the base plate 10 are fitted with perforated bars 28 and 28', each comprising a number of holes 29,29'. The bases 53' and 54' of the angle brackets 53 and 54 have notches 62 in alignment with the holes 29,29' in the perforated bars 28,28' so that the angle brackets 53 and 54 can be bolted to the perforated bars 28 and 28'. Close to the edges of the two support plates 2,2' holes are provided (not shown) which are also in alignment with the holes 29,29' in the perforated bars 28,28', and the support plates can, therefore, also be fastened to the bars by means of bolts 70.

A descending sheet edge separating device 64 for the stacked material is mounted on the outer side of each limiting face 53'',54'' of the angle brackets 53,54. In order to ensure sufficient free motion of the sheet edge separating devices 64 as they move downwardly with the decreasing stack, the base plate 10 is provided with two openings 34 and 35 through which the descending sheet edge separating devices 64 may pass, so that they need not rest on the base plate 10 when the height of the stack has dropped.

As shown in FIG. 2, each sliding plate 12,12' has another slot 13 and 14 extending parallel to the narrow sides of the base plate 10. These slots are engaged by guide pins 16 and 18 which are fastened to the cam disk 19. In addition, the guide pins 16 and 18 are guided in the longitudinal slot 5 of the lever 3. When the lever 3 is shifted, the cam disk 19 is pivoted on the pin 17 and, at the same time, the guide pins 16 and 18 engaging the slots 13 and 14 displace the sliding plates 12,12' in the direction of the long sides of the base plate 10. Another pin 15 on the cam disk 19 passes through the longitudinal slot of the lever 3 and serves for additionally guiding the cam disk 19, when the position of the lever 3 is changed.

The bottom plate 36 carries on its underside a cam roller 37, as indicated by a dotted line in FIG. 3 (See also FIG. 1). This cam roller 37 engages in the guiding path 21 of the cam disk 19, with the guiding path 21, so to speak, forming a restricted guidance for the cam roller 37. Close to either of its narrow sides, the bottom plate 36 has two slots 40, 41 and 42, 43 extending in parallel with the narrow sides of the base plate 10 and engaged by the pins 51,51' of the base plate 10. With any pivoting movement of the cam disk 19 the sliding plates 12 and 12' are displaced in the longitudinal direction relative to the base plate 10, whereas the bottom plate 36 is displaced in the lateral direction along the narrow sides of the base plate 10. The edge of the cam disk 19 lying underneath the bottom plate 36 can be seen through a recess 48 in this plate. The lower (in FIG. 3) long side of the bottom plate 36 is provided with two notches 46 and 47, where the ends of two tension springs 24 and 24' are attached. As can be seen from FIG. 2, these tension springs extend across the sliding plates 12 and 12', and their opposite ends are fastened by two fixing bolts 44 and 45 which are bolted to the base plate 10. The two tension springs 24,24' pull the bottom plate 36 into its respective final position, as determined by the stop position adopted by the lever 3. This final position of the bottom plate 36 is fixed by two stops 30 and 30' on the base plate. The stops are equipped with spring supported stop pins 32 and 32', and two stop blocks 38 and 39 which are attached to the underside of the bottom plate 36 abut these pins when the bottom plate 36 is in its final position. The stop pins 32 and 32' are provided with compression springs 31,31' which are arranged inside the stops 30,30' and encompass the stop pins. In order to ensure that the limiting lugs 49 and 50 on the bottom plate can move freely when the bottom plate is displaced, each of the support plates 2,2' has an opening 65. In addition, at least one of the support plates 2,2' has an opening 68; after the last sheet in the stack has been taken up a signal switch 68' enters into this opening and is thereby actuated to indicate that the magazine is empty. This signal switch may be mounted on a rocking shaft supporting the take-up rollers for the uppermost sheet in the stack.

A gap 66 between the two support plates 2 and 2' is closed by a cover plate 52.

The lever 3 is guided in two slot-shaped guideways 8,9 provided in the base plate 10, which guideways branch at a branching point F. Guideway 8 is completely straight, whereas guideway 9 extends substantially parallel to guideway 8, and is connected to branching point F via a slightly curved section. Guideway 9 ends in a section which is also slightly curved and has its extremity on the imaginary extension of guideway 8. In the area of the guideways 8 and 9, a bar 55 is mounted on the underside of the base plate 10, which extends beyond these guideways. Immediately below the straight guideway 8, this bar 55 has three stop positions A, B and C, and below the branching off guideway 9 a single stop position D is provided. The stop position D is below and in alignment with the imaginary extension of the straight guideway 8.

FIGS. 4 to 7 show kinematic representations of the motion mechanism of magazine 1 in stop positions A, B, C and D of the lever 3, and they also show the respective positions of the cam disk 19, the limiting faces 53'' and 54'' and the angle brackets 53 and 54 as well as the distance between the pivot point E (at pin 17) of the cam disk and the cam roller 37 which is located on the underside of the bottom plate 36.

Figure 4:
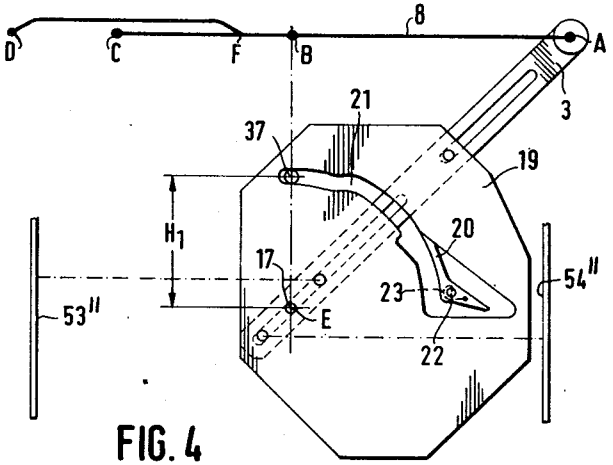
FIGS. 4 to 7 are kinematic representations of the cam disk and the lateral limiting faces in 4 stop positions of the lever.

In stop position A, See FIG. 4, the lever 3 has adopted the extreme righthand position within guideway 8, and the position of the cam disk 19 is such that the cam roller 37 is located at the end of the guiding path 21 which is the farther end away from a tongue 20. The guiding path 21 comprises (see FIG. 2) an inclined section a, a circular section b with an indentation c and a bent section d having the shape of an elongate S. The above-mentioned tongue 20 has an angular shape and is mounted on a pin 22, so as to pivot against the force of a spring 23. The shortest distance between the cam roller 37, which may, e.g., be a ball bearing, and the pivotal point E, i.e., the pivot pin 17, is given by the value $H_1$.

Figure 5:
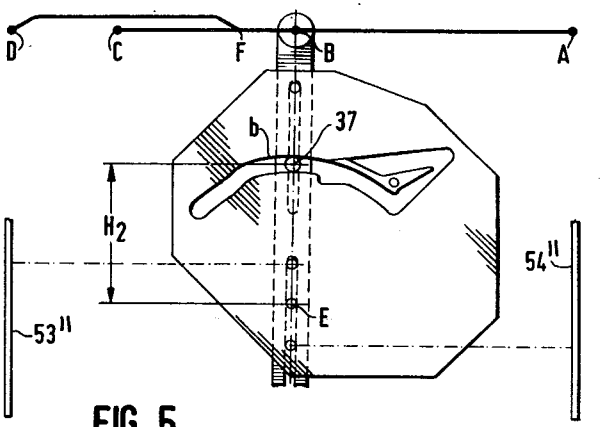

FIG. 5 shows the lever 3 in stop position B which is on the center line between the two limiting faces 53″ and 54″. The cam disk 19 has then turned such that the guiding path 21 is substantially horizontal and the cam roller 37 is approximately in the center of the circular section b. The distance between the pivotal point E and the cam roller 37 is then $H_2$, and the two limiting faces 53″ and 54″ are farther away from one another than in stop position A of the lever 3.

Figure 6:
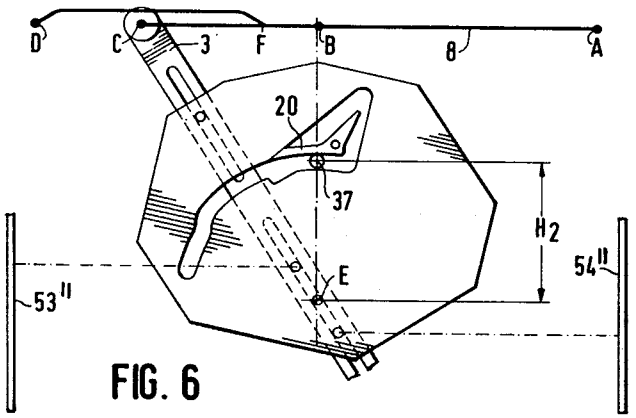

In FIG. 6 the lever 3 has adopted stop position C at the left-hand end of the straight guideway 8, while the cam roller 37 is in the area of the tongue 20, and the distance $H_2$ between the cam roller 37 and the pivotal point E is unchanged with respect to stop position B of of the lever 3. The distance between the two limiting faces 53″ and 54″, however, has increased as compared to stop position B.

Figure 7:
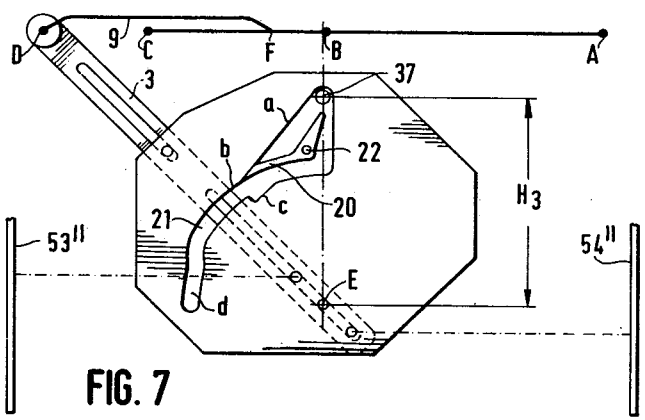

In order to arrive at stop position D, shown in FIG. 7, the lever 3 must first be pushed back from stop position C to the branching point F in guideway 8, and it is then displaced along guideway 9 up to position D. The distance $H_3$ between the cam roller 37 and the pivotal point E and the distance between the two limiting faces 53″ and 54″ are greater than in the above-described cases. In this instance, the cam disk 19 pivots such that the cam roller 37 travels to the upper end of the inclined section a of the guiding path 21. When, starting from this position, the lever 3 is returned to stop position A, the inclined section a of the guiding path 21 moves in such a way that the cam roller 37 is guided toward the pivotal point E and downwardly along the center line between the two limiting faces, pushing against the tongue 20, so that the tongue pivots on the pin 22 and turns downwardly into the indentation c. While the lever 3 is gradually shifted in the direction of position A, the cam roller 37 slides along the circular section b of the guiding path until the stop position A is reached and the cam roller is again in the position shown in FIG. 4. As soon as the cam roller 37 has left the inclined section of the guiding path 21 and has entered into the circular section b, the tongue 20 is pushed out of the indentation c by the spring 23 and again contacts the inclined section a.

As can be seen from FIGS. 4 and 7, there is a slight clearance between the cam roller 37 and the bend of the guiding path 21, which in practice amounts to about 2 to 3 mm and serves to prevent the cam roller 37 from hitting against the rim of the guiding path 21 when the springs 24, 24′ press the bottom plate 36 against the stops 30,30′.

Figure 8:
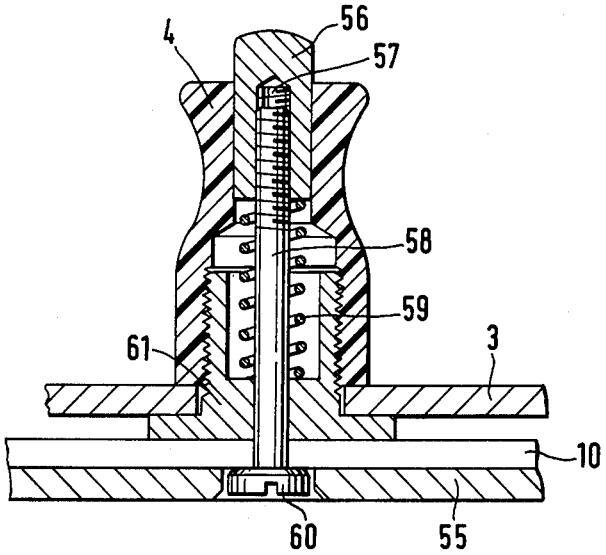
FIG. 8 is a partial sectional view of the lever handle in one of the stop positions.

The partial sectional view according to FIG. 8 shows the lever 3 with its handle 4 in one of the stop positions A, B, C or D. The handle 4 encloses a push button 56 which abuts the upper end of a compression spring 59 encompassing a threaded bolt 58. The lower end of the compression spring 59 is supported by the bottom of a bearing sleeve 61 which is screwed into the handle 4. The push button 56 is provided with a threaded blind hole 57 accommodating the threaded bolt 58. A bolt head 60 at the lower end of the threaded bolt 58 has a diameter exceeding the diameter of the threaded bolt. One of the stop positions A, B, C or D shown in the bar 55 attached to the underside of the base plate 10 is adapted to house the bolt head 60. In order to shift the lever 3 from one stop position to another stop position, the push button 56 is depressed against the force of the spring 59, whereby the bolt head 60 moves downwardly and extends beyond the bar 55 clear of the stop position, so that the lever 3 can be freely displaced. When the stop position chosen is reached by changing the position of the lever 3, the push button 56 is simply released and the bolt head 60 snaps into the new stop position.

What is claimed is:

1. A magazine for holding a stack of sheet materials and being adjustable to accommodate stacks of different size sheet materials, comprising:

a. a base plate;

b. two sliding plates mounted on said base plate so as to be longitudinally slideably displaceable with respect to each other;

c. a bottom plate positioned in spaced relationship above said sliding plates and being mounted on said base plate so as to be laterally slideably displaceable;

d. a cam follower mounted on the side of said bottom plate facing said sliding plates;

e. means, mounted on one opposing axial end of each of said sliding plates, for longitudinally confining the stack of sheet materials;

f. means, mounted on at least one lateral side of said bottom plate, for laterally confining the stack of sheet materials; and g. means, including a lever pivoted on said base plate and positioned in the space between said sliding plates and said bottom plate and a cam disk pivoted on said base for rotation with movement of said lever and positioned above said lever in said space so as to engage the camming surface of said cam disk with said cam follower, for longitudinally displacing said sliding plates and laterally displacing said bottom plate in response to movement of said lever.

2. A magazine according to claim 1, wherein said lever includes a longitudinal slot therein and said displacing means further comprises a first pin attached to said base plate, about which said cam disk is rotatable, and a second pin attached to said cam disk, said first and second pins passing through said slot.

3. A magazine according to claim 2, wherein each of said sliding plates includes a slot extending transverse thereto and said displacing means further comprises third and fourth pins attached to said cam disk, one of said pins engaging with each of said transverse slots.

4. A magazine according to claim 3, wherein said third and fourth pins also pass through the slot in said lever.

5. A magazine according to claim 4, wherein the camming surface of said cam disk comprises a guiding path including an inclined section (a), a circular section (b) with an indentation (c) and a bent section (d) having the shape of an elongate S, and wherein said cam disk further comprises an angular tongue pivotably mounted in section (a) of said guiding path and being spring biased against the wall of said guiding path opposite to said indentation (c).

6. A magazine according to claim 3, further comprising two support plates, each of which is connected with one of said sliding plates and which are positioned in longitudinally spaced relationship on said bottom plate, and a cover plate which at least partly covers said two support plates.

7. A magazine according to claim 6, wherein said base plate is generally rectangular and said two sliding plates are L-shaped, with the longer legs of the sliding plates extending in parallel with the long sides of said base plate and the shorter legs of the sliding plates extending in parallel with the narrow sides of the base plate, and wherein the sliding plates face one another in such a way that, when pushed together, they form a rectangle.

8. A magazine according to claim 7, further comprising a perforated bar arranged on the shorter leg of each sliding plate flush with its outer lateral edge.

9. A magazine according to claim 8, wherein said longitudinal confining means comprises two angle brackets, one connected at its base to each of the perforated bars of the sliding plates with the limiting faces defined by the portion perpendicular to the base of each being adapted to longitudinally contact the stacked material.

10. The magazine according to claim 9, wherein said support plates and the bases of said angle brackets are detachably connected to said perforated bars by means of bolts.

11. A magazine according to claim 9, further comprising means for separating a sheet edge of the stacked material mounted on the outer lateral side of each limiting face of said angle brackets.

12. A magazine according to claim 11, further comprising two openings in said base plate forming passages for said sheet edge separating means when the height of the stack decreases.

13. A magazine according to claim 6, wherein each of said two support plates includes a notch which forms a space for the movement of said lateral stack confining means on the bottom plate.

14. A magazine according to claim 13, wherein said lateral stack confining means comprise upstanding lugs attached to said bottom plate.

15. A magazine according to claim 1, further comprising two slot-shaped guideways extending in the base plate, the first extending in a straight line and the second extending from a common branching point intermediate the ends of the first divergently away from the first, then parallel to the first and finally convergently to an imaginary extension of the first, and a bar secured to the underside of said base plate along said guideways.

16. A magazine according to claim 15, wherein said lever comprises a handle which is displaceable along said guideways and is selectively arrestable in a plurality of stop positions.

17. A magazine according to claim 16, wherein the bar has three stop positions (A, B, C) below said first guideway and one stop position (D) below said second guideway, said stop position (D) lying on the extension of said first guideway.

18. A magazine according to claim 17, wherein said handle includes a push button abutting the upper end of a compression spring, which compression spring encircles a threaded bolt and rests with its lower end against the bottom of a bearing sleeve the threaded bolt being screwed into a threaded blind hole provided in the push button and having a bolt head at its lower end, which by its dimensions is adapted to be locked into place in one of the stop positions (A, B, C, D).

19. A magazine according to claim 15, further comprising two stops comprising spring supported stop pins attached to the base plate and stop blocks cooperatively mounted on the underside of the bottom plate, whereby said stops are contacted by said stop blocks when the bottom plate is displaced laterally toward the guideways in said base plate.

20. A magazine according to claim 1, wherein each sliding plate includes a plurality of slots extending in parallel with the long sides of the base plate, one slot in each being arranged in the longer legs of the sliding plates and the others in the shorter legs, and wherein said base plate further comprises a plurality of protruding pins which engage in at least three of said slots in each of said sliding plates.

21. A magazine according to claim 20, further comprising a spacer mounted on each of said protruding pins and means including a locking pin for maintaining said spacer in a predetermined position on the pin, whereby the bottom plate is supported by the spacers.

22. A magazine according to claim 20, wherein the bottom plate is generally rectangular and includes slots extending in parallel with and close to its short sides, and said slots are engaged by said protruding pins.

23. A magazine according to claim 22, further comprising two notches provided in opposing ends on one of the long sides of the bottom plate, and two tension springs with each of one of said springs extending from one of said notches across one of the sliding plates and being fastened at its opposite end.

24. A magazine according to claim 1, wherein said base plate includes a pull-out slide bar arranged along one of its long sides and another pull-out slide bar axially attached to its underside.

25. A magazine according to claim 24, further comprising an opening in at least one of said support plates and a signal switch arranged to enter into said opening after the last sheet of the stack has been taken up, whereby the signal switch is actuated to indicate that the magazine is empty.

* * * * *